US006428143B2

(12) United States Patent
Irihara et al.

(10) Patent No.: US 6,428,143 B2
(45) Date of Patent: Aug. 6, 2002

(54) INK JET IMAGE FORMING METHOD AND INK JET IMAGE FORMING DEVICE

(75) Inventors: Kouichi Irihara, Nara; Hiroyuki Sawai, Nabari, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/799,605

(22) Filed: Mar. 7, 2001

(30) Foreign Application Priority Data

Mar. 7, 2000 (JP) ..... 2000-062255

(51) Int. Cl.[7] ..... B41J 2/21
(52) U.S. Cl. ..... 347/43; 347/98; 347/100
(58) Field of Search ..... 347/43, 15, 100, 347/98, 21, 96, 14, 16; 106/31.43, 31.52, 31.57

(56) References Cited

U.S. PATENT DOCUMENTS 5,568,169 A * 10/1996 Dudek et al. ..... 347/43
5,596,355 A 1/1997 Koyama et al. ..... 347/43
5,933,164 A * 8/1999 Sato et al. ..... 347/43
6,084,621 A * 7/2000 Shioya ..... 347/101
6,158,834 A * 12/2000 Kato et al. ..... 347/9
6,260,947 B1 * 7/2001 Pinkernell ..... 347/43

FOREIGN PATENT DOCUMENTS

| | | |
|---|---|---|
| JP | 05338136 | 12/1993 |
| JP | 07149036 | 6/1995 |
| JP | 0976591 | 3/1997 |
| JP | 11005664 | 1/1999 |

* cited by examiner

*Primary Examiner*—Lamson D. Nguyen

(57) ABSTRACT

To provide an ink jet image forming method and an ink jet image forming device capable of forming an image of superior quality by using quickly drying ink and slowly drying ink in combination, wherein deviation which may occur in a discharge position of ink causes no reduction in the resolution of the image, black ink is adopted as the slowly drying ink, and so is white ink as one of the quickly drying ink. A white dot is formed with the white ink in a position to form a black dot on white recording paper, thereafter applying the black ink thereto. Deviation which may occur in the discharge position of the quickly drying white ink on the recording paper thus becomes almost visually unnoticeable.

8 Claims, 13 Drawing Sheets

INK JET IMAGE FORMING METHOD AND INK JET IMAGE FORMING DEVICE

FIELD OF THE INVENTION

The present invention relates to an ink jet image forming method using ink of two or more kinds (for example, quickly drying ink and slowly drying ink) in combination, and an ink jet image forming device, and in particular to improvements in image quality by attaining higher resolution.

BACKGROUND OF THE INVENTION

A common ink jet image forming device (hereinafter referred to as "ink jet printer") sequentially performs image formation by discharging drops of ink to surfaces of sheets of recording paper to be fed successively. The sheets of recording paper subjected to image formation are successively discharged to a discharge tray where they are stacked.

Further, there has been proposed the following conventional ink jet printer capable of image formation by using two or more different inks and superimposing all the inks over one another on recording paper.

Japanese Unexamined Patent Publication No. 330086/1993 (Tokukaihei 5-330086 published on Dec. 14, 1993) discloses improvements in a dot formation method in the case of using slowly drying ink and quickly drying ink in combination, the slowly drying black ink having high reproducibility but taking time to dry and the quickly drying black ink drying rapidly but producing low-density print. Specifically, when forming color dots in an area adjacent to an area where black dots are formed, an interface therebetween is formed by superimposing quickly drying black ink or a combination of inks of C (cyan), M (magenta) and Y (yellow) over one another, while forming the other area with slowly drying black ink, thereby enhancing reproducibility in a black color while suppressing exudation in the interface between black dots and color dots.

Further, Japanese Unexamined Patent Publication No. 149036/1995 (Tokukaihei 7-149036 published on Jun. 13, 1995) discloses a technique of using black ink having low permeability to recording paper (slowly drying ink), and inks of C, M and Y, having higher permeability (quickly drying ink). Specifically, it is arranged such that, when forming a color dot area adjacent to an area where black dots are formed, black dots in the black dot area are thinned out and color dots (staggered dots) are formed therein instead. In addition, the publication No. 149036/1995 also discloses formation of black dots over color dots, thereby preventing exudation in the boundaries between the black dot area and the color dot area, while cutting drying time of black dots.

The techniques disclosed in the foregoing two publications, however, require high accuracy in determining a position to discharge quickly drying ink to be applied to the interface between the black area and the color area. Specifically, even when the position to discharge quickly drying ink slightly deviates from a predetermined position of the interface, a boundary line of the interface becomes irregular due to the presence of the quickly drying ink, which results in the reduced resolution of an image. Thus, there has been such a potential risk that quickly drying ink which is discharged so as to suppress exudation of dots and attain superior image quality turns out to be a factor to degrade image quality.

SUMMARY OF THE INVENTION

In view of the foregoing problems, it is an object of the present invention to provide an ink jet image forming method and an ink jet image forming device capable of forming an image of superior quality by using a combination of two or more different inks including, for example, quickly drying ink and slowly drying ink, in which deviation which may occur in a discharge position of ink causes no reduction in the resolution of an image.

In order to attain the foregoing object, the ink jet image forming method according to the present invention, which uses a combination of two or more different inks including at least white or clear, colorless quickly drying ink and an ink different from the quickly drying ink, includes the step of applying the white or clear, colorless quickly drying ink and the different ink onto the recording medium either one over another or adjacently.

With the foregoing method, it is possible to largely cut drying time of the different ink. Moreover, depending on a combination of the quickly drying ink and a different ink, an image to be formed with the different ink can be made clearer. More specifically, when adopting slowly drying ink as the different ink to be used in combination with the quickly drying ink, the drying time can be shortened more than when forming dots of the slowly drying ink singly on the recording medium. Further, since a common recording medium such as recording paper is white, the quickly drying ink, which functions as a sort of assistant ink which helps the slowly drying ink to dry, remains unnoticeable, i.e., the quickly drying ink causes no degradation in image quality.

Furthermore, when the quickly drying ink is white ink, and the different ink is color ink having a color other than white, contrast to the white ink makes an image in the color ink clearer, thus attaining superior image quality. Note that, as the color ink, it is desirable to adopt ink having a color of relatively low brightness such as black ink.

Further, a preferable example of the ink jet image forming device of the present invention adopting the foregoing ink jet image forming method performs image formation on a recording medium by using a combination of two or more different inks including at least white or clear, colorless quickly drying ink and an ink different from the quickly drying ink, and further, the device includes ink discharge control means for controlling discharge of the quickly drying ink and the different ink so as to apply the white or clear, colorless quickly drying ink and the different ink onto the recording medium either one over another or adjacently.

Additional objects, features, and strengths of the present invention will be made clear by the description below. Further, the advantages of the present invention will be evident from the following explanation in reference to the drawings.

DESCRIPTION OF THE EMBODIMENTS

Figure 1:
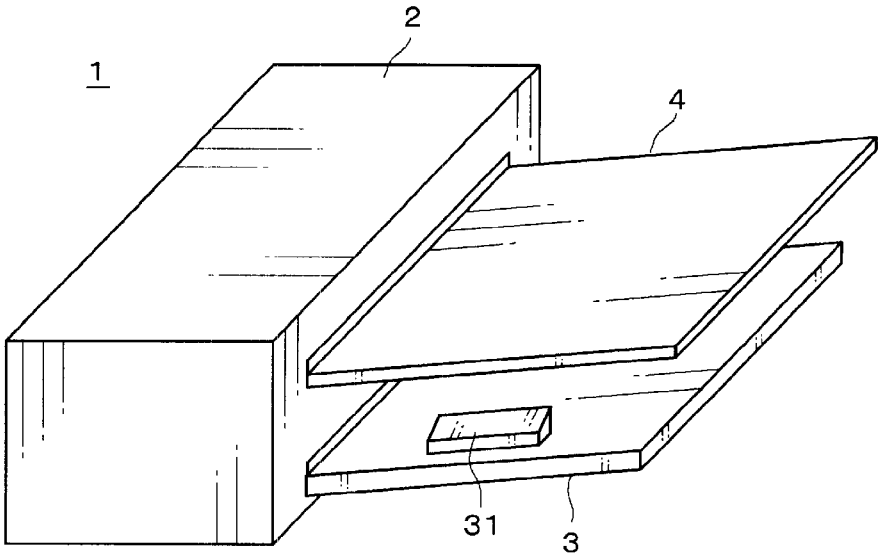
FIG. 1 is a perspective view showing an external outline of a color ink jet printer according to the present invention.

First, the following will explain an outline of the present invention without reference to drawings. In the present invention, by using white or clear, colorless quickly drying ink as one of two or more different inks to be used in image formation, deviation which may occur in a discharge position thereof becomes unnoticeable.

More specifically, a prerequisite for the present invention is the use of an ink jet image forming method for performing image formation on an upper surface of a recording medium by using two or more different inks in combination. Moreover, it is arranged such that at least one of two or more different inks is white or clear, colorless quickly drying ink, and dots of the white or clear, colorless quickly drying ink and dots of other ink (for example, either color ink other than the white ink or slowly drying ink) are applied to a surface of a recording medium (on a recording surface, or on a surface, such as an upper or lower surface of the recording medium) either one over another or adjacently.

An arrangement of a device to adopt the ink jet image forming method includes an ink jet image forming device for performing image formation on a recording medium by using two or more different inks in combination, that is a prerequisite. It is arranged such that at least one of the two or more inks to be used in the ink jet image forming device is white or clear, colorless quickly drying ink. In addition, the ink jet image forming device includes quickly drying ink discharge control means for controlling discharge of the quickly drying ink so that the dots of the white or clear, colorless quickly drying ink and the dots of the other ink are either superimposed over one another or adjacently applied on the recording medium.

As explained, at image formation on the recording medium, when applying the dots of the quickly drying ink and the dots of the other ink over one another or adjacently, deviation which may occur in the discharge position of the quickly drying ink to the recording medium becomes substantially unnoticeable outwardly because of the white or clear, colorless quickly drying ink, thus preventing deterioration of the resolution of an image due to deviation in the discharge position. Further, when adopting white ink as the quickly drying ink, and applying it in a position adjacent to the other ink (for example, color ink having relatively low brightness such as black ink, other than the white ink), contrast between the two kinds of ink becomes large, thus making an outline of an image formed with the other ink clear, thereby obtaining a high resolution image of superior quality.

Note that, as discussed in detail later, in the present invention, a description "different inks superimposed over one another, or dots of different inks superimposed over one another" refers to not only a state in which different inks are completely superimposed over one another, but also a state in which different inks are overlapped one another.

The ink jet image forming method in which the other inks are specified includes the following: an ink jet image forming method for performing image formation on a recording medium by using quickly drying and slowly drying inks in combination, in which the quickly drying ink is white or clear, colorless ink, and dots of the white or clear, colorless quickly drying ink and dots of slowly drying ink are applied to a recording medium so that they are superimposed over one another or they adjoin one another.

An arrangement of a device to adopt the ink jet image forming method includes an ink jet image forming device for performing image formation on a recording medium by using two or more different inks in combination, where at least one of the two or more different inks to be used in the ink jet image forming device is white or clear, colorless quickly drying ink. In addition, the ink jet image forming device includes quickly drying ink discharge control means for controlling discharge of the quickly drying ink so that the dots of the white or clear, colorless quickly drying ink and dots of the other ink are either superimposed over one another or adjacently applied on the recording medium.

With the foregoing arrangement, deviation which may occur in the discharge position of the quickly drying ink to the recording medium becomes substantially unnoticeable outwardly. Further, the slowly drying ink essentially has superior color reproducibility to the quickly drying ink, thereby attaining high-quality images. Further, in case where white ink is adopted as the quickly drying ink so as to be applied in a position adjacent to the dots of the slowly drying ink (color ink except white ink: ink having relatively high brightness such as black ink is particularly preferable), contrast between the inks becomes large, thereby attaining images of higher quality.

In addition, the use of the quickly drying ink causes the slowly drying ink to enhance its permeability with respect to a recording medium (recording paper), thereby cutting drying time of ink which forms dots. Accordingly, when performing image formation sequentially with respect to a plurality of recording media, a subsequent recording medium can be discharged only after ink which was previously discharged onto a recording medium dries completely, thereby preventing a subsequent recording medium from being stained with undried ink on a preceding recording medium.

Conventionally, a proposal for allowing subsequent recording paper to be stacked on recording paper previously fed after ink thereon becomes completely dry has been disclosed in Japanese Unexamined Patent Publication No. 338136/1993 (Tokukaihei 5-338136 published on Dec. 21, 1993), Japanese Unexamined Patent Publication No. 76591/1997 (Tokukaihei 9-76591 published on Mar. 25, 1997), and Japanese Unexamined Patent Publication No. 5664/1999 (Tokukaihei 11-5664 published on Jan. 12, 1999). The publication No. 338136/1993 discloses an arrangement in which an operation for obtaining a black pixel ratio in an image to be formed and detection of an ambient temperature are concurrently performed, based on results of which varies a carrier velocity of recording paper to which ink is applied, thereby making it possible to surely dry ink on a sheet of recording paper on a discharge tray before a subsequent sheet of recording paper is discharged. The publication No. 76591/1997 discloses an arrangement in which, measuring time required to dry ink ("drying time of ink", hereinafter) on the previously discharged recording paper and elapsed time since the time the recording paper was completely discharged, intermittent feeding of a subsequent sheet of recording paper is performed so as to allow the elapsed time to exceed drying time of ink. The publication No. 5664/1999 discloses an arrangement in which a discharge stacker includes a plurality of steps of discharge supports between which is successively replaced a sheet of recording paper subjected to image formation, thereby delaying contact time between sheets of recording paper so as to allow the sheets of recording paper to be in contact each other after ink becomes dry.

However, in a technique disclosed in the publication No. 338136/1993, though the black pixel ratio and the ambient temperature are taken into account, the results of which are utilized only to adjust drying time. Therefore, an image formation rate may possibly decrease depending on an image to be formed and/or an ambient temperature. Particularly, a relatively low ambient temperature results in considerable reduction in the image formation rate. Similarly, a technique disclosed in the publication No. 76591/1997 is to lengthen time required to form an image on a subsequent sheet of recording paper, and therefore, it may be possible that the image formation rate is considerably reduced depending on an image to be formed. Further, a technique disclosed in the publication No. 5664/1999 not only complicates the arrangement of the discharge stacker but also requires driving force for subsequently replacing sheets of recording paper between the discharge supports, which results in an increased power consumption in an image forming device as a whole.

According to the present invention, while solving the foregoing problems in prior art, it is possible to have an arrangement in which a subsequent recording medium can be discharged after ink on a previously discharged recording medium becomes completely dry, thereby preventing stains on a recording medium, and realizing an image forming device capable of faster image formation in accordance with increased counts of image formation per unit hour.

The following are patterns of discharge control for quickly drying ink by the quickly drying ink discharge control means. First, it is arranged such that dots of white or clear, colorless quickly drying ink are applied, before applying dots of slowly drying ink onto a recording medium, in a very position where the dots of slowly drying ink are also applied (hereinafter referred to as "discharge pattern (1)") or in an area which overlaps an area where the dots of slowly drying ink are applied (hereinafter referred to as "discharge pattern (2)"). In addition, it is arranged that, before the application of the dots of slowly drying ink to the recording medium, the dots of white or clear, colorless quickly drying ink are applied in advance with respect to a position adjacent to the position where the dots of slowly drying ink are applied (hereinafter referred to as "discharge pattern (3)").

When applying the inks in a single position as in the discharge pattern (1), the white or clear, colorless quickly drying ink enables entire dots formed with slowly drying ink to dry in a shorter period of time. Further, when overlapping areas to which the inks are respectively applied as in the discharge pattern (2), the quickly drying ink as an undercoat makes a partial outline of slowly drying ink clearer, thereby attaining an image of superior quality. Further, when applying quickly drying ink in a position adjacent to a position to apply slowly drying ink as in the discharge pattern (3), contrast between the two inks becomes large, thereby also attaining an image of superior quality.

Furthermore, an example of discharge control for quickly drying ink by the quickly drying ink discharge control means is such that the dots of quickly drying ink on the recording medium are arranged to become larger than those of slowly drying ink on the recording medium. Accordingly, even when a slight deviation occurs in a discharge position of slowly drying ink over the dots of quickly drying ink, the dots formed with quickly drying ink can serve as the undercoat of the entire dots formed with slowly drying ink. This allows the entire dots of slowly drying ink to maintain higher permeability with respect to a recording medium, and the drying time of ink which forms dots to be surely cut, thereby improving reliability of an image forming device.

Further, the ink jet image forming device according to the present invention may have such an arrangement as to provide area recognition means for recognizing an area on a recording medium where an image is formed with slowly drying ink, where the quickly drying ink discharge control means, in receipt of output of the area recognition means, applies quickly drying ink in a position which overlaps an outline of the foregoing area. Further, it may also be arranged such that the area recognition means for recognizing an area on a recording medium where an image is formed with slowly drying ink is provided, where the quickly drying ink discharge control means (an arrangement of ink discharge means), in receipt of output of the area recognition means, applies quickly drying ink in an external position adjacent to an outline of the foregoing area.

With the foregoing arrangements, an outline of the area where an image is formed with slowly drying ink can be made clear. In addition, even when the area where an image is formed with slowly drying ink is relatively large, quickly drying ink is applied only in an outline portion of the area. Thus, in comparison with application of quickly drying ink over the whole area, the amount of use of the quickly drying ink can be largely reduced while making an outline of the area clear, thereby preventing a large increase in running costs of an image forming device, while attaining an image of superior quality.

Meanwhile, the following are control operations of the quickly drying ink discharge control means according to information on an image. First, there is provided text area recognition means for recognizing an area where text is printed out of images to be formed on a recording medium. Then, the quickly drying ink discharge control means, in receipt of output of the text area recognition means, applies quickly drying ink in a position either overlapping or adjacent to the area where text is printed. Provided further is pictorial image area recognition means for recognizing an area where a pictorial image is formed out of all the images to be formed on a recording medium. Then, further provided is discharge control means for regulating ink discharge operations by the quickly drying ink discharge control means so as to inhibit, in receipt of output of the pictorial image area recognition means, discharge of the white or clear, colorless quickly drying ink with respect to the area where a pictorial image is formed.

With the foregoing arrangement, high resolution can be attained only in a portion to print text which particularly requires a clear outline. On the contrary, a portion to form a pictorial image where image formation according to modes such as a photographic mode is performed does not require high resolution because the presence of a certain degree of exudation in dots of ink results in an image in much real representation. For this reason, as far as the portion to form a pictorial image is concerned, not using quickly drying ink and thereby allowing exudation of ink results in an image as desired by a user, thus making it possible to carry out suitable image forming operations with respect to areas to print text and to form a pictorial image, respectively, which are included in a recording medium.

A concrete example of image forming operations by the ink jet image forming device is such that image formation is sequentially carried out on a plurality of recording media by using quickly drying ink and slowly drying ink in combination, thereafter discharging a subsequent recording medium so that it is stacked on a previously discharged recording medium. When carrying out such image forming operations, as explained, there is a concern that a recording medium may be stained with ink on the previously discharged recording medium which is not completely dry when the subsequent recording medium is discharged. However, in the present invention, the use of quickly drying ink enhances permeability of slowly drying ink with respect to a recording medium, thereby cutting drying time of ink which forms dots, and preventing a subsequent recording medium from being stained with ink on a previously discharged recording medium.

Note that, when adopting white ink as quickly drying ink, it is particularly preferable that a recording surface of a recording medium is substantially as white as the white ink. In that case, deviation which may occur in the discharge position of white ink becomes unnoticeable. In addition, since it is held that most of recording paper which is frequently used as a recording medium are white in general, the use of white ink as quickly drying ink is extremely advantageous.

Further, it may also be arranged such that as two or more different inks are used at least the quickly drying ink either having substantially the same color as that of the recording medium or being clear and colorless, and color ink, where the dots of the color ink having a color different from the color of the quickly drying ink, and the dots of the quickly drying ink are either superimposed over one another or adjacently formed on the recording medium.

In that case, since the recording surface of the recording medium and the quickly drying ink (except the one being clear and colorless) have virtually the same color, deviation which may occur in the discharge position of the quickly drying ink remains unnoticeable not only when the recording medium is white but also when the recording medium has a color other than white. In addition, though it depends on a combination of the quickly drying ink and the color ink, contrast between the two inks becomes large, thereby attaining an image of superior quality. Furthermore, in case where the color ink is slowly drying ink (a representative of which is a pigment ink, but the slowly drying ink is not limited thereto) which has a milder drying property than that of quickly drying ink, drying time thereof can be further shortened.

Further, it may also be arranged such that as two or more different inks are used at least the quickly drying ink either having substantially the same color as that of the recording medium or being clear and colorless, and slowly drying ink, where the dots of the quickly drying ink and the dots of the slowly drying ink are either superimposed over one another or adjacently formed on the recording medium. In that case, slowly drying ink having the same color as that of the quickly drying ink may also be used.

Note that, in the present invention, "clear, colorless ink" refers to an ink composition which is virtually clear and colorless, and capable of printing and drying on a recording medium. This clear, colorless ink needs a superior drying property (i.e., a quick drying property) compared to slowly drying ink, and an example of which includes a quickly drying ink composition virtually excluding a coloring substance. More specifically, desirable examples thereof include a mixture of water, monoethyleneglycol, diethyleneglycol and polyvinylalcohol. Note that, an optimum mixture ratio among water, monoethyleneglycol, diethyleneglycol and polyvinylalcohol in this order according to percentage by weight is 60:10:30:0.5.

The embodiment of the present invention will be explained more in detail with reference to drawings.

Figure 2:
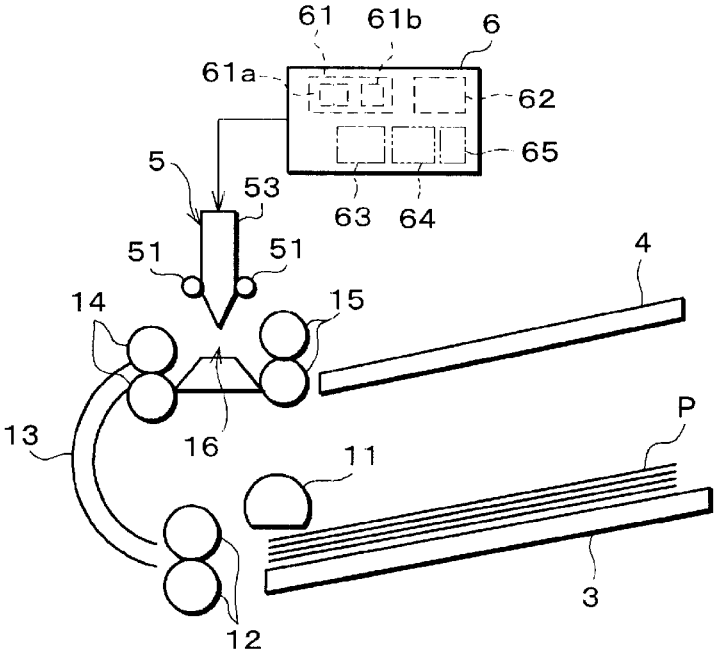
FIG. 2 is an internal view of the color ink jet printer of FIG. 1.

An Explanation of the Configuration of the Printer According to the Present Invention First, the following will explain a configuration of the color ink jet printer (ink jet image forming device) 1 according to the present invention with reference to FIGS. 1 and 2. FIG. 1 is a perspective view showing an external outline of the color ink jet printer 1. FIG. 2 is an internal view of the color ink jet printer 1.

The color ink jet printer 1 has a feed tray 3 on the front (i.e., the right hand side in FIG. 1) of a cabinet 2, and a discharge tray 4 is provided above the feed tray 3. On the feed tray 3 is provided a position determining member 31 for determining a discharge position of recording paper (recording medium) P (see FIG. 2).

On the other hand, as shown in FIG. 2, inside the cabinet 2 are provided, from the side of the feed tray 3 to the side of the discharge tray 4, a pick-up roller 11, feed rollers 12, a U-shape transport path 13, PS rollers 14, an ink jet mechanism (image forming section) 5 and discharge rollers 15 in this order along a transport direction of the recording paper P. In addition, the discharge rollers 15 and the discharge tray 4 make up a discharge section of the present invention.

Figure 3:
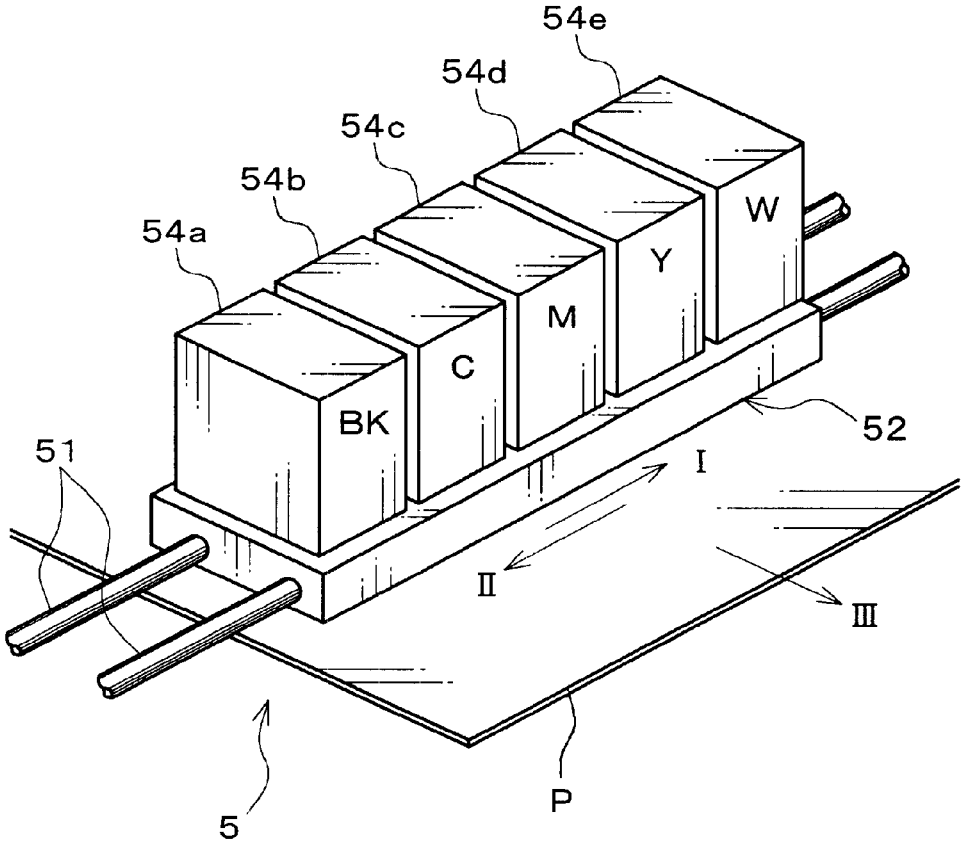
FIG. 3 is a perspective view showing an ink carriage in the color ink jet printer of FIG. 1, and peripheral portions thereof.

The ink jet mechanism 5 includes a pair of ink head carriage holding shafts 51 which extend in a direction perpendicular to the paper surface of FIG. 2, an ink head carriage 52 (see FIG. 3) which is held by the ink head carriage holding shafts 51, and an ink head 53 which is scanned by shuttling to and fro together (jointly) with the ink head carriage 52 along each of the ink head carriage holding shafts 51. In addition, on the ink head carriage 52 are mounted ink tanks 54*a* through 54*e*. To be more specific, as shown in FIG. 3, on the ink head carriage 52 are mounted four ink tanks 54*a* to 54*d* respectively containing inks of Bk (black), C (cyan), M (magenta) and Y (yellow), and an ink tank 54*e* containing ink of W (white), that is a feature of the present embodiment, side by side in this order in a main scan direction (i.e., the to and fro shuttling direction of the ink head carriage 52 shown as arrows I and II in FIG. 3).

Further, in the ink head 53 are provided a plurality of nozzles (a disposing state of these nozzles will be described later) which separately connect to the ink tank 54*a* to 54*e* via supply paths which are not shown. Note that, the ink tanks and the nozzles for discharging inks respectively stored in the ink tanks make up five different ink discharge means (discharge means), where ink discharge means for W (white) ink make up either discharge means (A) or discharge means (C) of the present invention, while the other ink discharge means make up either discharge means (B) or discharge means (D) of the present invention.

Further, as shown in FIG. 2, the present color ink jet printer 1 has a controller 6 for controlling operations of different sections. Note that, processing by, and operations of, the color ink jet printer 1 explained below are set to be controlled by the controller 6, unless otherwise stated.

An Explanation of the Disposing State of the Nozzles

Figure 4:
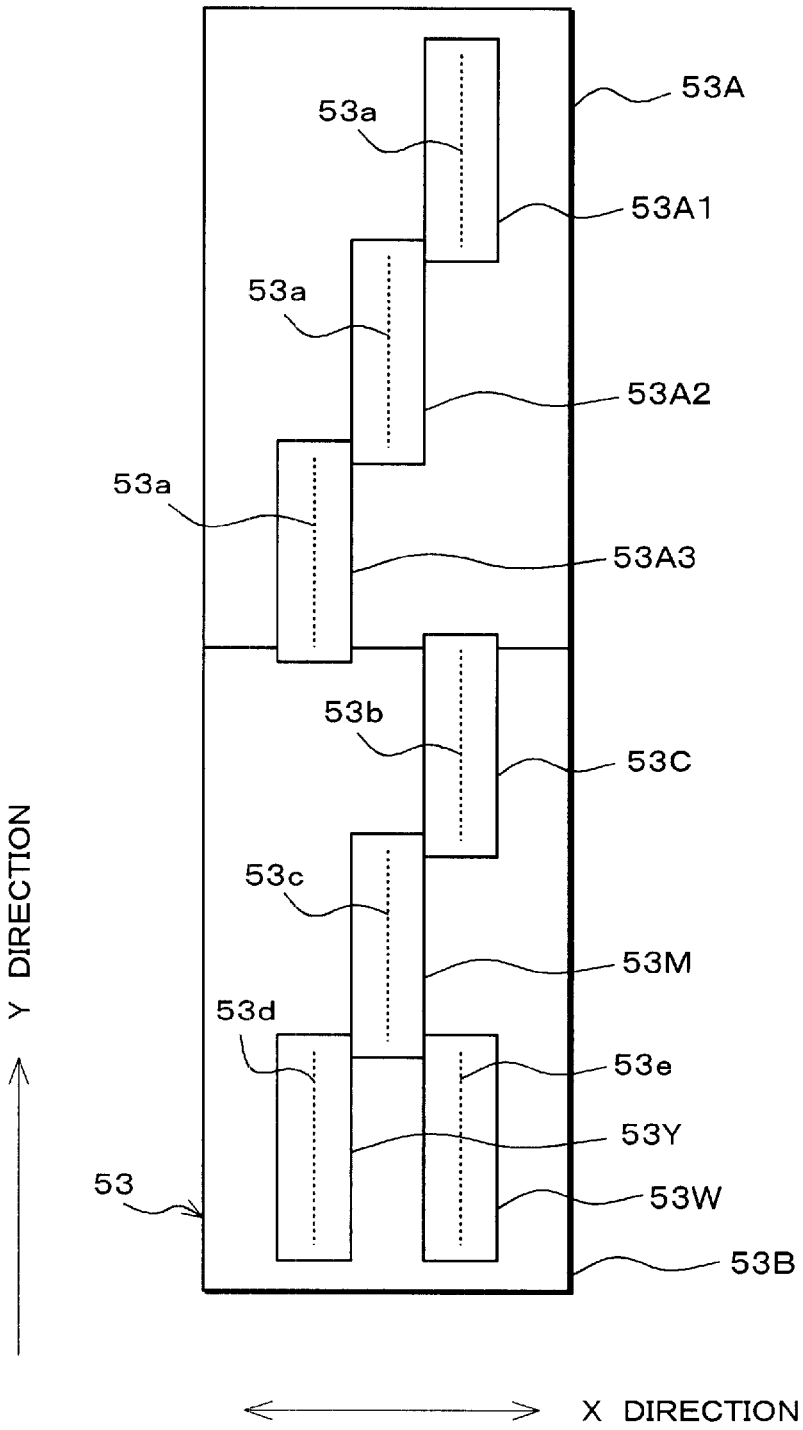
FIG. 4 is a layout plan of nozzles, viewed from an ink head of the color ink jet printer of FIG. 1 in a direction of recording paper.

Next, the following will explain the disposing state of the nozzles. FIG. 4 is a diagram showing the disposing state of the nozzles 53*a* to 53*e*, viewed from above the ink head 53 (viewed from the side of the ink head 53 in a direction toward the recording paper P). In FIG. 4, an X direction is the to and fro shuttling direction of the ink head 53, and a Y direction is the transport direction of the recording paper P.

The ink head 53 is made up of a black head block 53A and a color head block 53B. The black head block 53A has three different black heads 53A1, 53A2 and 53A3 provided therein. The color head block 53B includes a cyan head 53C, a magenta head 53M, an yellow head 53Y and a white head 53W corresponding to colors of cyan (C), magenta (M), yellow (Y) and white (W), respectively.

The black heads 53A1, 53A2 and 53A3 respectively have black nozzles 53*a* connected to the black tank 54*a*. Likewise, the cyan head 53C has a cyan nozzle 53*b* connected to the cyan tank 54*b*, the magenta head 53M has a magenta nozzle 53*c* connected to the magenta tank 54*c*, the yellow head 53Y has an yellow nozzle 53*d* connected to the yellow tank 54*d*, and the white head 53W has a white nozzle 53*e* connected to the white tank 54*e*, respectively.

These nozzles 53*a* to 53*e* are respectively provided in a plurality of positions, and nozzles to discharge ink of a single color are disposed in line along the Y direction in FIG. 4. In addition, each string of nozzles is made up of, for example, sixty-four different nozzles, which provide the resolution of 600 dpi.

An Explanation of Print Operations

When starting print operations of the color ink jet printer 1, first, a sheet of the recording paper P placed on the feed tray 3 is picked up by the pick-up roller 11 and guided into the transport path 13 by the feed rollers 12. Thereafter, the sheet of recording paper P is adjusted by the PS rollers 14 so that the edges of the sheet are set at a proper position with respect to image information and transported to an image forming position 16 which faces the ink head 53. Then, when the sheet of recording paper P passes through the image forming position 16, the nozzles 53*a* to 53*e* in the ink head 53 separately discharge respective drops of ink based on a position of the sheet of recording paper P and image information, thus forming an image on an upper surface of the sheet of recording paper P.

The foregoing image forming operations will be explained more specifically. When the sheet of recording paper P is transported to the image forming position 16, the nozzles 53*a* to 53*e* discharge ink to the sheet of recording paper P as the ink head carriage 52 shifts in a direction of arrow I (main scan direction) shown in FIG. 3, thus forming an image on the sheet of recording paper P. When the ink head carriage 52 shifts to one end of the sheet of recording paper P, the sheet of recording paper P is shifted (transported) in the transport direction thereof only in a predetermined measure (shifted in a sub scan direction shown as an arrow III in FIG. 3), thereafter stopping it. Next, an image is formed as the ink head carriage 52 shifts in a direction of arrow II (main scan direction) in FIG. 3. Thus, the image forming operations by the shuttling of the ink head carriage 52 and transport operations of a sheet of recording paper P are alternately carried out, thereby forming images all over the sheet of recording paper P.

A sheet of recording paper P in which images are formed substantially all over a surface thereof is discharged by the discharge rollers 15 with respect to the discharge tray 4, thus discharging a sheet of recording paper P subjected to the predetermined image formation to the discharge tray 4 in a face-up state (a state in which an image forming surface is turned upward).

The Drying Time of Ink

In the present embodiment, the black ink is ink made of pigment. On the other hand, the inks such as C, M, Y and W are ink made of dye. The ink made of pigment has a higher color reproducibility than that of the ink made of dye (quickly drying ink), but it is slowly drying ink which takes time to dry. Therefore, when using black ink having a slow drying property in order to improve image quality, the drying time of ink tends to be larger in an area having high black dot density.

Figure 5:
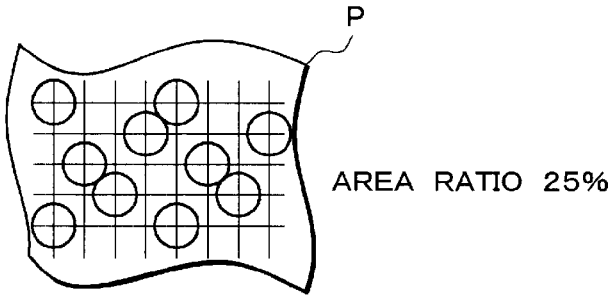
FIGS. 5(*a*), 5(*b*), 5(*c*) and 5(*d*) are layout plans of dots in different black dot area ratios.
Figure 5:
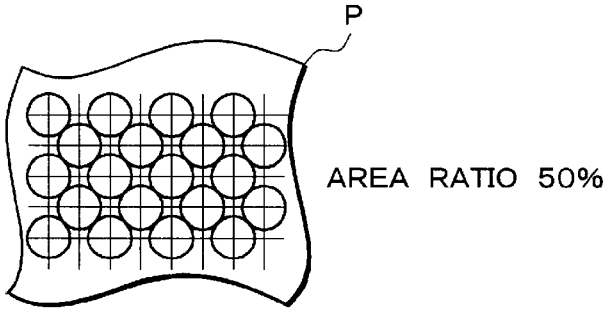
Figure 5:
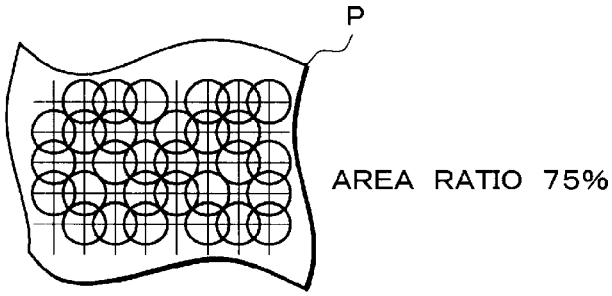
Figure 5:
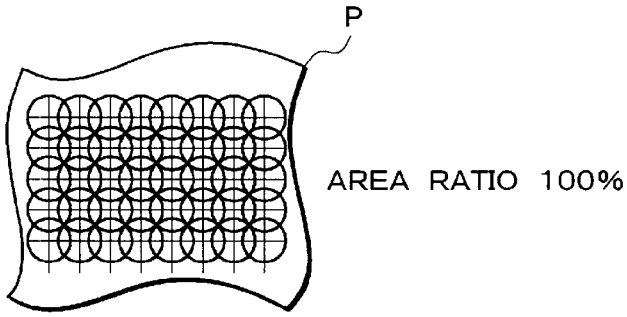

Particularly, when a black dot area ratio (a ratio of a black dot area to a whole area of recording paper) exceeds 50% and adjacent dots start overlapping one another, the time required for ink to dry becomes extremely long. FIGS. 5(*a*) to 5(*d*) show examples of black dot forming positions at different black dot area ratios. FIGS. 5(*a*), 5(*b*), 5(*c*), 5(*d*) show the black dot forming positions at the black dot area ratios 25%, 50%, 75% and 100%, respectively. Ink tends to spread and permeate in a fiber direction (i.e., a direction of a phase) of paper composing the recording paper P rather than a direction of a thickness of the recording paper P, and therefore, the overlapping state of dots largely affects the drying time.

Figure 6:
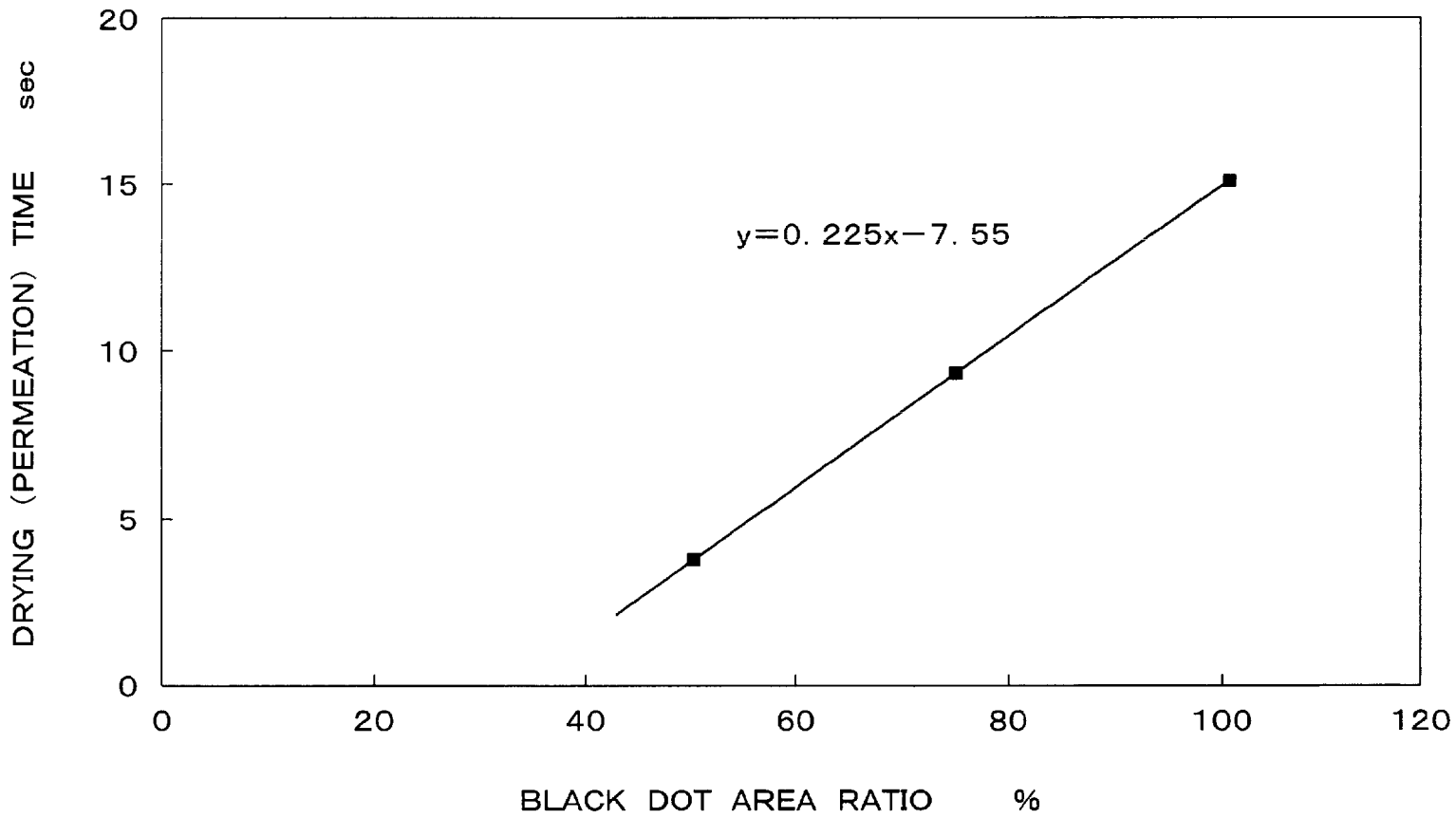
FIG. 6 is a graph showing a relationship between a black dot area ratio and drying time.
Figure 7:
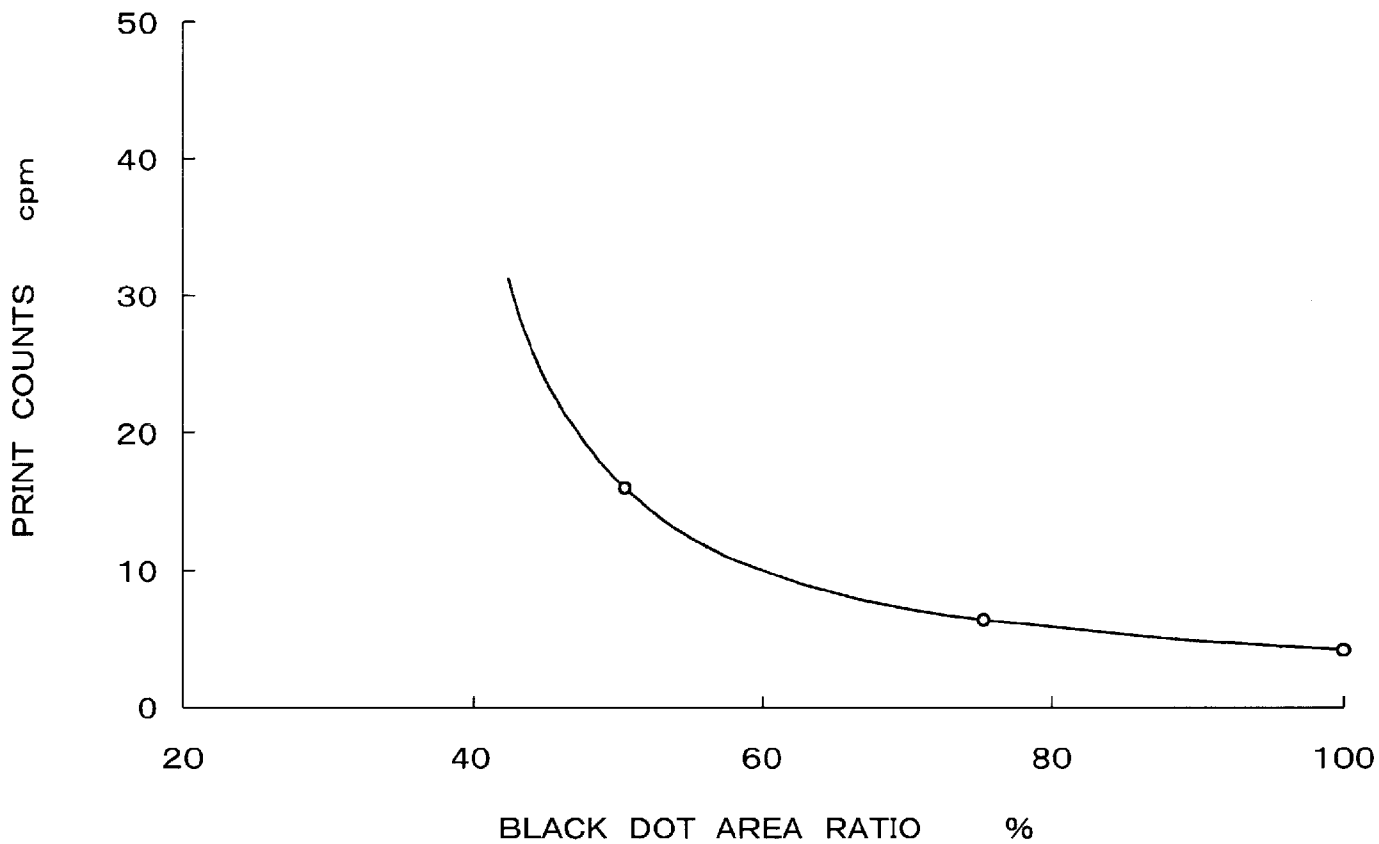
FIG. 7 is a graph showing a relationship between a black dot area ratio and print counts.

Data showing this fact are presented in FIGS. 6 and 7. FIGS. 6 and 7 are graphs respectively showing a relationship between a black dot area ratio and drying (permeation) time and a relationship between a black dot area ratio and print counts.

The drying (permeation) time in FIG. 6 is the drying (permeation) time (measured values) obtained when black dots are formed evenly by using black ink having a slow drying property so that black dot area ratios become 50%, 75%, and 100%, respectively (when forming black dots as shown in FIGS. 5(*b*), 5(*c*) and 5(*d*)).

Further, the "print counts" in FIG. 7 refer to counts of print per minute on a sheet of A4 sized recording paper P, which is represented by obtaining the reciprocal of the drying (permeation) time obtained in the above.

An Explanation of the Jet Target of White Ink

Next, the following will explain a plurality of embodiments of jet operations of white ink when forming an image on the recording paper P by the color ink jet printer 1 having the foregoing arrangement. In any of the following embodiments, a jet of white ink is directed at the same position where a black dot is formed or in a vicinity thereof.

First Embodiment

Figure 8:
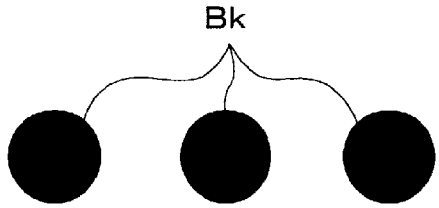
FIGS. 8(*a*) and 8(*b*) are diagrams showing a state of ink jet according to a First Embodiment.
Figure 8:
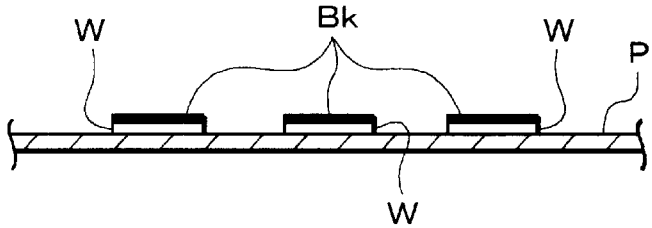

First, in the First Embodiment, the size of a dot which is formed with white ink and the size of a dot which is formed with black ink are adjusted to be the same, and the jet targets of the two ink are also adjusted to be the same. FIGS. 8(*a*) and 8(*b*) show an example in which a jet of ink is thus directed at three different dot forming positions (FIG. 8(*a*) is a plan view of the dots, and FIG. 8(*b*) is a side view of the dots). Specifically, with respect to a portion to form a black dot are directed, first, a jet of white ink W (quickly drying ink), then, a jet of black ink Bk (slowly drying ink) one over another, thus previously directing a jet of white ink W at an area where an image is conventionally formed with black ink Bk alone.

In order to realize the foregoing jet operation of white ink W, the control means 6 has ink discharge control means 61 for controlling discharge of white ink W and the different ink (see FIG. 2). The ink discharge control means 61 is made up of quickly drying ink discharge control means 61*a* for controlling operation of discharge means for white ink W, and slowly drying ink discharge control means 61*b* for controlling operation of discharge means for a different ink (here, black ink Bk). Note that, though not shown in FIG. 2, there can be provided three more slowly drying ink discharge control means respectively corresponding to discharge means for inks of Y (yellow), M (magenta) and C (cyan).

Further, the quickly drying ink discharge control means 61*a*, based on image information, recognizes a jet target of black ink Bk in advance. Then, with respect to the recording paper P which has been transported in the Y direction shown in FIG. 4, the quickly drying ink discharge control means 61*a* directs white ink W from the white nozzle 53*e* at the jet target of black ink Bk, thereby forming a dot of white ink W in that position. Thereafter, when the position where the dot of white ink W was formed reaches a position to face the black head block 53A by the transport of the recording paper P, a jet of black ink Bk is directed at the dot of white ink W through the control of the slowly drying ink discharge control means 61*b*, thereby forming a dot made up of two layers as shown in FIGS. 8(*a*) and 8(*b*).

In the ink jet operation of the present embodiment, an image is thus formed with black ink Bk which is the slowly drying ink on an undercoat of white ink W which is the quickly drying ink. Consequently, deviation which may occur in the discharge position of white ink W on the recording paper P becomes almost visually unnoticeable, thus preventing degradation in the resolution due to the deviation in a discharge position, thereby obtaining an image of superior quality.

Further, with the ink jet operation of the present embodiment, the use of quickly drying ink as an undercoat enhances permeability of black ink Bk with respect to the recording paper P, thereby suppressing spread of the black ink Bk in an in-plane direction of the recording paper P. Therefore, the size of a dot of black ink Bk on the recording paper P can be suppressed to a predetermined size, thereby suppressing exudation of black ink Bk, and improving the resolution of an image.

Further, in the ink jet operation of the present embodiment, the permeability of black ink Bk (slowly drying ink) with respect to the recording paper P is enhanced, thereby cutting the drying time of ink which forms dots. Accordingly, without using a particular means (a heater, for example) for drying ink on the recording paper P, the time required for an image to be formed can be shortened, while preventing the recording paper P from being stained with undried ink, thereby increasing counts of recording paper P capable of image formation per unit hour, and realizing high performance by the faster color ink jet printer 1.

Figure 9:
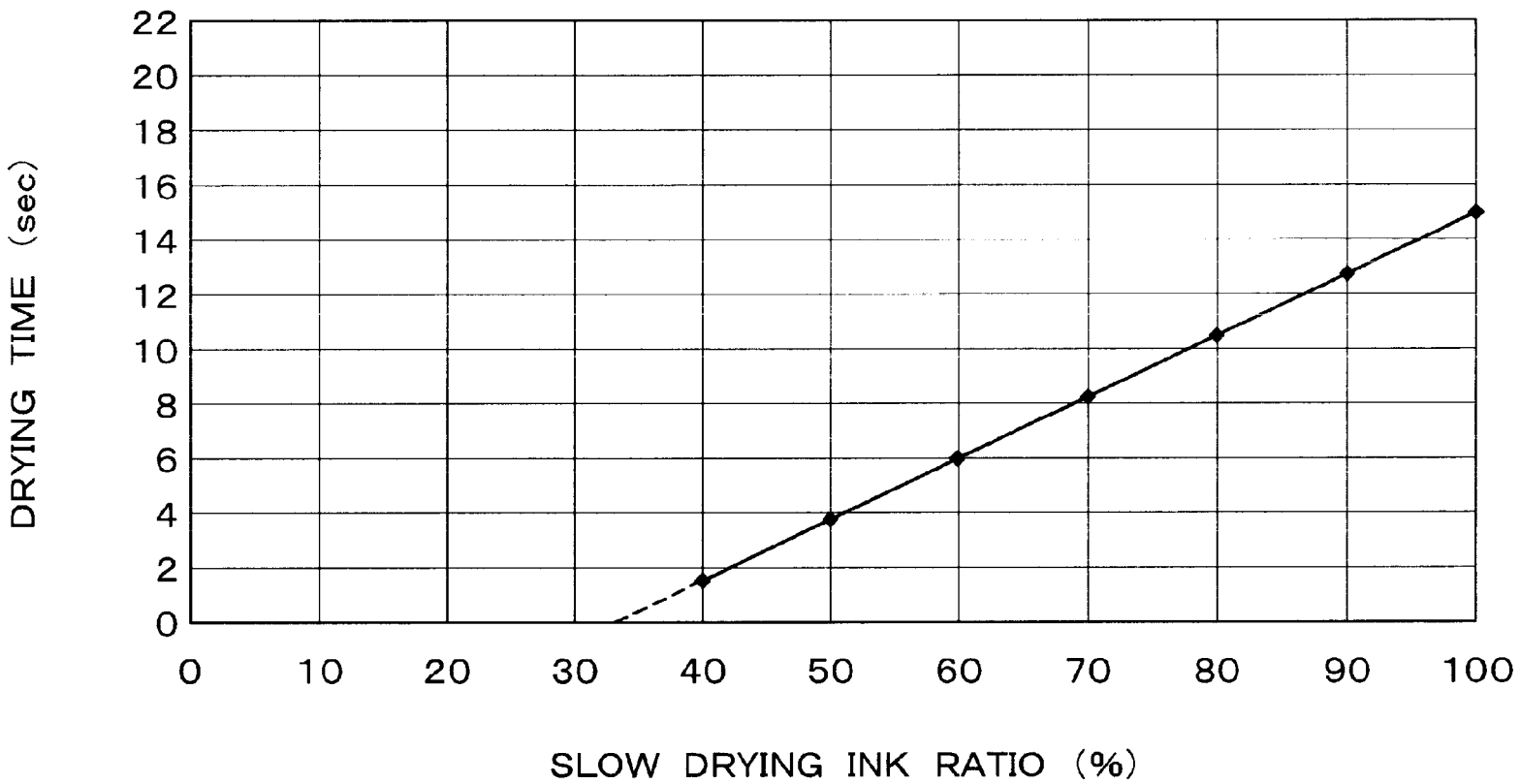
FIG. 9 is a graph showing a relationship between a use ratio of slowly drying ink (100×using amount of slowly drying ink/(using amount of slowly drying ink+using amount of quickly drying ink)), and drying time, when a black dot area ratio is 100%.

Here, a relationship between a ratio of slowly drying ink to a whole amount (volume) of ink to be used (slowly drying ink+quickly drying ink), and the drying time of ink (the time required for ink to completely dry) will be explained. FIG. 9 is a graph showing a relationship between a ratio of slowly drying ink and drying time, where the black dot area ratio is 100%. For example, when the ratio of slowly drying ink to the whole amount of ink to be used is 100% (when using no quickly drying ink), the required drying time is 15 sec, whereas drying time is cut down to about 4 sec when the ratio is 50% (when discharging the same amount of slowly drying ink and quickly drying ink).

Figure 10:
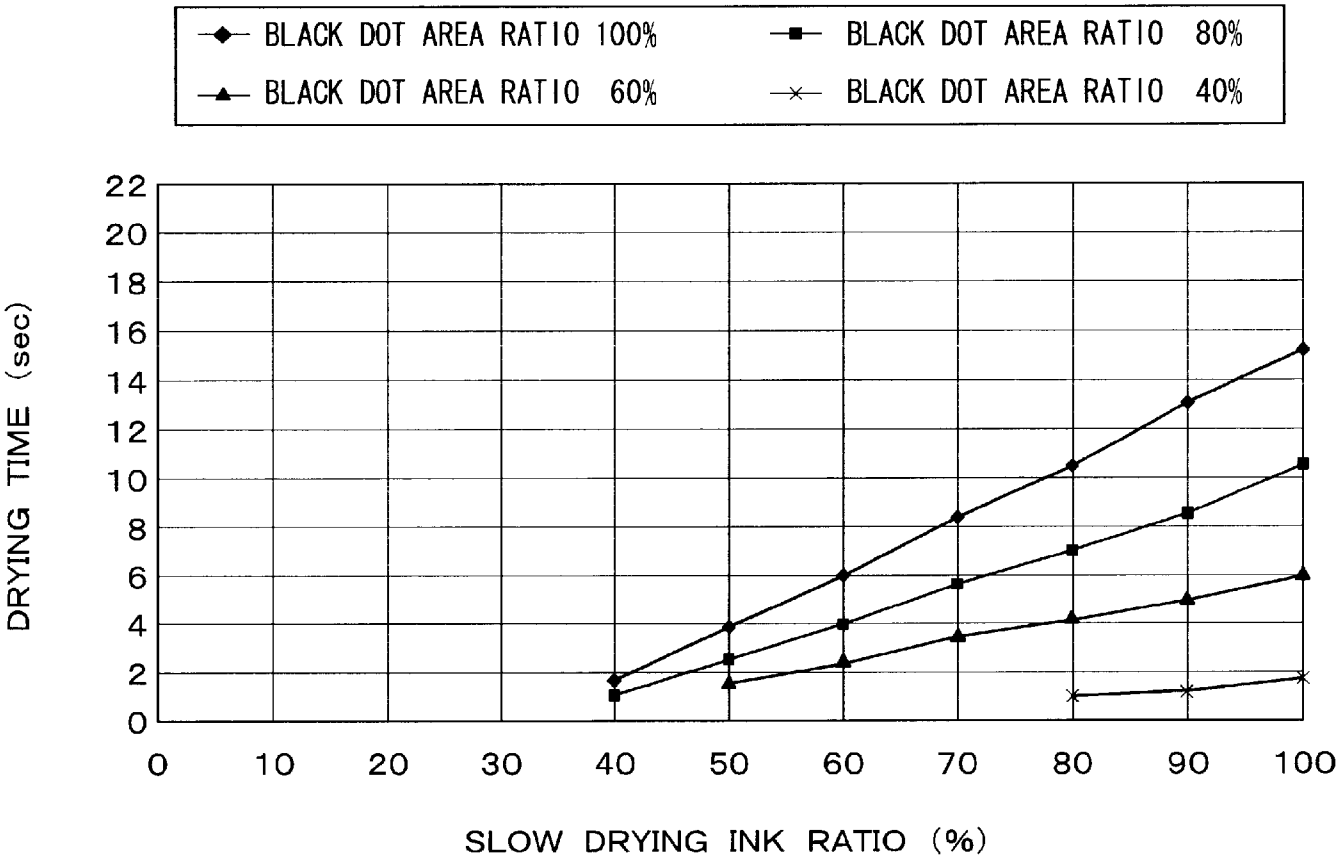
FIG. 10 is a graph showing a relationship between a use ratio of slowly drying ink and drying time, when changing a black dot area ratio.

Meanwhile, FIG. 10 is a graph showing a relationship between the ratio of slowly drying ink to the whole amount of ink to be used, and drying time, in case where the black dot area ratio varies. As is clear from the graph, drying time becomes short as the ratio of slowly drying ink becomes low, and also, drying time becomes short as the black dot area ratio becomes low.

Thus, it is understood that the time required for ink to dry can be shortened more when using quickly drying ink together with slowly drying ink than in the case of forming an image with slowly drying ink alone. The present embodiment utilizes this principle so as not only to improve the resolution of an image but also to realize high performance by the faster color ink jet printer 1 by preventing recording paper P from being stained with undried ink.

Second Embodiment

Figure 11:
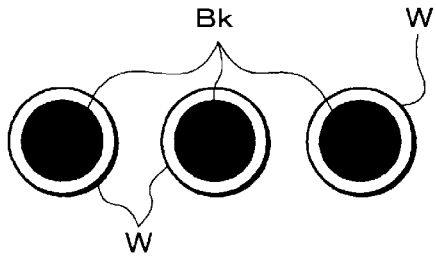
FIGS. 11(*a*) and 11(*b*) are diagrams showing a state of ink jet according to a Second Embodiment.
Figure 11:
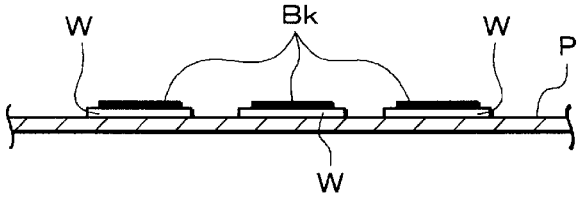

In the Second Embodiment, the size of a dot formed with white ink W is set to be slightly larger than the size of a dot formed with black ink Bk, and the jet targets of the two inks W and Bk are adjusted to the same. FIGS. 11(*a*) and 11(*b*) show an example in which a jet of ink is thus directed at three dot forming positions (FIG. 11(*a*) is a plan view of the dots, and FIG. 11(*b*) is a side view of the dots). Specifically, a jet of white ink W (quickly drying ink) of a larger amount of discharge than a planned amount (volume) of discharge of black ink Bk is directed at a portion to form black dots on the recording paper P, thereafter directing a jet of black ink Bk (slowly drying ink) at the same portion.

The quickly drying ink discharge control means 61*a* according to the present embodiment also recognizes the jet target of black ink Bk in advance based on image information. Then, the quickly drying ink discharge control means 61*a*, prior to the application of black ink Bk, directs white ink W from the white nozzle 53*e* at the jet target of black ink Bk. The discharge amount of white ink W at this time is set to be larger than the discharge amount of black ink Bk. Thereafter, a jet of black ink Bk is directed at the dot thus formed with white ink W, thereby forming a dot made up of two layers as shown in FIGS. 11(*a*) and 11(*b*).

With the jet operation of ink of the present embodiment, as in the First Embodiment above, the spread of black ink Bk on the recording paper P (i.e., in an in-plane direction) can be suppressed, and exudation of black ink Bk can be suppressed, thereby improving the resolution of an image. In addition, the drying time of ink which forms dots can be shortened, thereby cutting the time required to form an image while preventing recording paper P from being stained with undried ink.

Further, in the case of the present embodiment, because of the presence of white ink W around the perimeter of a black dot (i.e., the rim of a white dot), contrast between black and white makes an outline of the black dot clear, thus also improving the resolution of an image.

Figure 12:
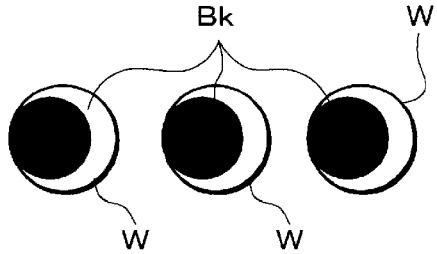
FIGS. 12(*a*) and 12(*b*) are diagrams showing a state in which an jet target of black ink slightly deviated in the Second Embodiment.
Figure 12:
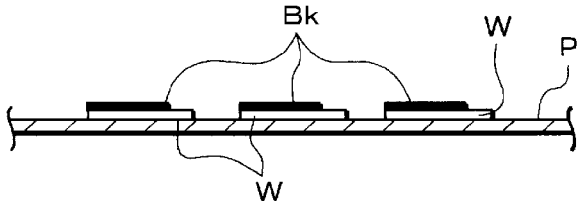

Additionally, in the case of the present embodiment, as shown in FIGS. 12(*a*) and 12(*b*), even when the jet target of black ink slightly deviates, an undercoat of a white dot can still catch a black dot. Therefore, even when a jet of black ink is directed at the jet target with poor accuracy, high-resolution image formation can be performed, while cutting the drying time of ink.

Third Embodiment

In the Third Embodiment, a black area of a predetermined area which is composed of black dots is formed on the recording paper P. Then, the size of a dot of white ink W and the size of a dot of black ink Bk are adjusted to be the same, and the jet target of white ink W is set to be the same as the jet targets of black dots forming an outline of the black area.

Figure 13:
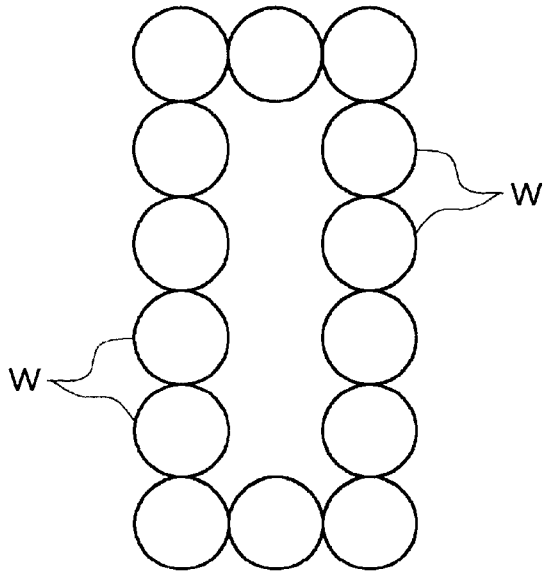
FIGS. 13(*a*) and 13(*b*) are diagrams showing a state of ink jet in a Third Embodiment.
Figure 13:
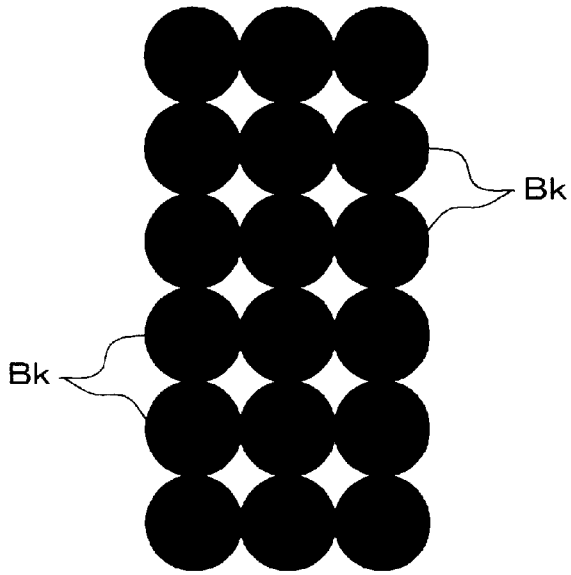

FIG. 13(*a*) shows a state in which white dots of white ink W are formed along the outline, and FIG. 13(*b*) shows a state in which the black area is formed with black ink Bk.

In order to thus perform the jet operation of white ink W, the control means 6 includes the quickly drying ink discharge control means 61*a* for controlling discharge of the white ink W, and area recognition means 62 for recognizing an area to form the black area based on image information (see FIG. 2). The quickly drying ink discharge control means 61*a* receives output of the area recognition means 62, and directs white ink W from the white nozzle 53*e* at a position on the outline of the area to form the black area so as to form dots of white ink W in that position (see FIG. 13(*a*)). Thereafter, the slowly drying ink discharge control means 61*b* directs black ink Bk from the black nozzle 53*a* at the whole black area (see FIG. 13(*b*)). Thus, on the outline portion of the black area, a jet of black ink Bk is directed at a dot of white ink W, thereby forming a dot of ink made up of two layers.

With the ink jet operation of the present embodiment, a similar effect to that in the First Embodiment can be obtained on the outline portion of the black area. Namely, even when deviation occurs in the discharge position of white ink W with respect to the recording paper P, the ink becomes almost visually unnoticeable, thereby preventing degradation of the resolution due to the deviation in a position, and obtaining an image of superior quality. In addition, on the outline portion, the permeability of black ink Bk with respect to recording paper P can be enhanced, thereby suppressing the spread of black ink Bk in the outline portion and the exudation of black ink Bk around the black area. As a result, a boundary line between the black area and an adjacent area thereto can be made clear, thus improving the resolution of an image.

Fourth Embodiment

Figure 14:
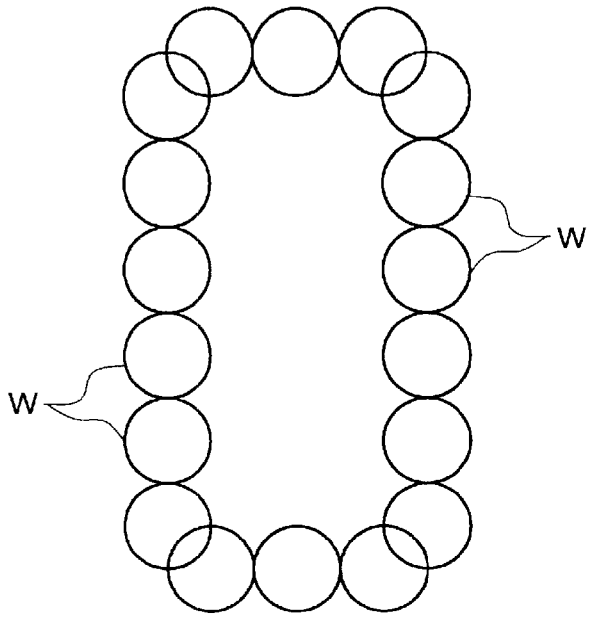
FIGS. 14(*a*) and 14(*b*) are diagrams showing a state of ink jet in a Fourth Embodiment.
Figure 14:
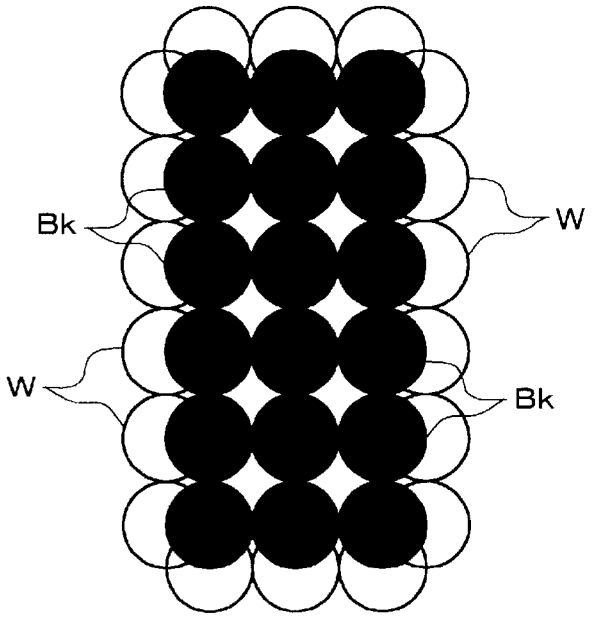

In the Fourth Embodiment, also, a black area of a predetermined area which is composed of black dots is formed on recording paper P. Then, in the present embodiment, as shown in FIGS. 14(*a*) and 14(*b*), the size of a dot of white ink W and the size of a dot of black ink Bk are adjusted to the same, and the jet target of white ink W is set at a position slightly outside the jet target of black dots making up an outline of the black area so as to allow the black and white dots to overlap each other.

The control means 6 according to the present embodiment, as in the Third Embodiment, includes the quickly drying ink discharge control means 61*a* and the area recognition means 62 (see FIG. 2).

With the ink jet operation of the present embodiment, as in the case of the Third Embodiment, the spread of black ink Bk in the outline portion of the black area and the exudation of black ink Bk around the black area can be suppressed. As a result, a boundary line between the black area and an adjacent area thereto can be made clear, thereby improving the resolution of an image.

In addition, with the ink jet operation of the present embodiment, because of the presence of white ink W around the perimeter of a black dot (i.e., the rim of a white dot), contrast between black and white makes an outline of the black dot clearer, thus also improving the resolution of an image.

Fifth Embodiment

In the Fifth Embodiment, text printing and pictorial image formation on recording paper P are performed. Namely, when image information includes both text and pictorial image data, a jet of white ink W is previously directed at a portion to print text, based on the text data.

The control means 6 according to the present embodiment includes the text area recognition means 63 (see FIG. 2) for recognizing an area where text is printed out of all the images to be formed on the recording paper P, and the quickly drying ink discharge control means 61*a*. The quickly drying ink discharge control means 61*a* receives output of the text area recognition means 63, and controls discharge of white ink W so that the white ink W is applied either to the area where text is to be printed or in a position externally adjacent to the perimeter of the area where text is to be printed. More specifically, white ink W is applied as an undercoat of a character to be printed when printing text, where a jet of white ink W is directed only at an outline portion of the character, and alternatively, a jet of white ink W is directed at a whole area where a plurality of characters are to be printed (an image formation area excluding a portion to form a pictorial image).

It is particularly necessary to maintain a clear outline of a character in the portion where text is printed, and therefore, it is arranged such that printing using white ink W is performed together with text printing. Note that, in case where a jet of white ink W is directed only at the outline portion of a character in text printing, it can be done so either in combination with, or after, text printing, though ink jet operation with a high degree of accuracy is required in that case. Therefore, commonly, it is preferable that the jet operation of white ink be performed prior to text printing.

On the other hand, the portion to form a pictorial image requires image formation according to a mode such as photographic mode, where high resolution is not necessary, and rather, the presence of a certain degree of spread in a dot of ink makes a real image. For this reason, white ink is not used in the portion to form a pictorial image so as to allow exudation of ink for pictorial image formation.

Further, in the present embodiment, the control means 6 may have another arrangement instead of the foregoing arrangement, which includes pictorial image recognition means 64 for recognizing an area where a pictorial image is formed out of all the images to be formed on the recording paper P, and discharge regulation means 65 for regulating, in receipt of output of the pictorial image recognition means 64, the control of discharge of ink by the quickly drying ink discharge control means 61*a* so as to inhibit discharge of white ink W with respect to the area where a pictorial image is formed (see FIG. 2).

Another Embodiment

The use of white ink W as quickly drying ink has been explained through the foregoing embodiments. However, the quickly drying ink of the present invention is not limited thereto, but clear and colorless ink may be adopted as quickly drying ink. Particularly, when the color of recording paper P is not white, it is preferable to adopt the clear and colorless ink. More specifically, in case where a jet of slowly drying color ink is directed either at the same jet target on the recording paper P where the clear and colorless ink was applied, or at a position adjacent to the jet target, the drying time of the color ink can be shortened, and moreover, the clear and colorless ink (assistant ink which helps the color ink to dry in a shorter period of time) applied onto the recording paper P is not visually recognizable, regardless of color of recording paper P.

Further, explanation of image formation in which slowly drying black ink Bk and quickly drying white ink W are superimposed over one another has been made through the foregoing embodiments. However, the image formation of the present invention is not limited thereto, but an image may also be formed by superimposing quickly drying inks having colors of C, M and Y and white or clear, colorless ink having quickly drying properties. Namely, a method of superimposing two different quickly drying inks is included in the scope of technical thought of the present invention. In that case, with dots of the white ink W as a background, dots of quickly drying color inks of C, M and Y become clear, thereby further improving the resolution of an image. Further, ink having a color other than black may be adopted as slowly drying ink.

Figure 15:
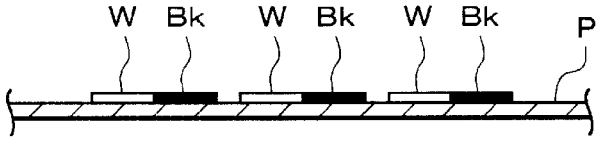
FIG. 15 is a diagram showing a state of ink jet when adjacently providing quickly drying ink and the other inks.
Figure 16:
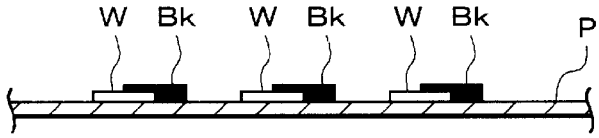
FIG. 16 is a diagram showing a state of ink jet when allowing a jet target of quickly drying ink to slightly deviate from that of the other inks.

Further, quickly drying ink (white ink or clear, colorless ink) is not necessarily provided under each of the other inks (Bk, C, M, Y) in a superimposing state, and as shown in FIG. 15, it may be provided adjacent to other ink. In that case, also, the presence of quickly drying ink W suppresses spread of the adjacent black ink Bk, thereby improving the resolution of an image. In addition, in the First Embodiment above, as shown in FIG. 16, the jet targets of a pair of quickly drying ink W and slowly drying ink Bk may be slightly changed so as to allow them to overlap each other.

Further, explanation of the use of five different inks as inks to form an image has been made through the foregoing embodiments. However, the inks to form an image are not limited thereto, but inks of not more than four different kinds or inks of not less than six different kinds may also be adopted instead. Namely, the present invention is widely applicable in any arrangement using at least two or more different inks including white or clear, colorless quickly drying ink and other ink which is used to form a dot on, or adjacent to, a dot of the quickly drying ink. Further, an arrangement capable of applying a diluent for dissolving these inks with respect to recording paper P may also be adopted.

Figure 17:
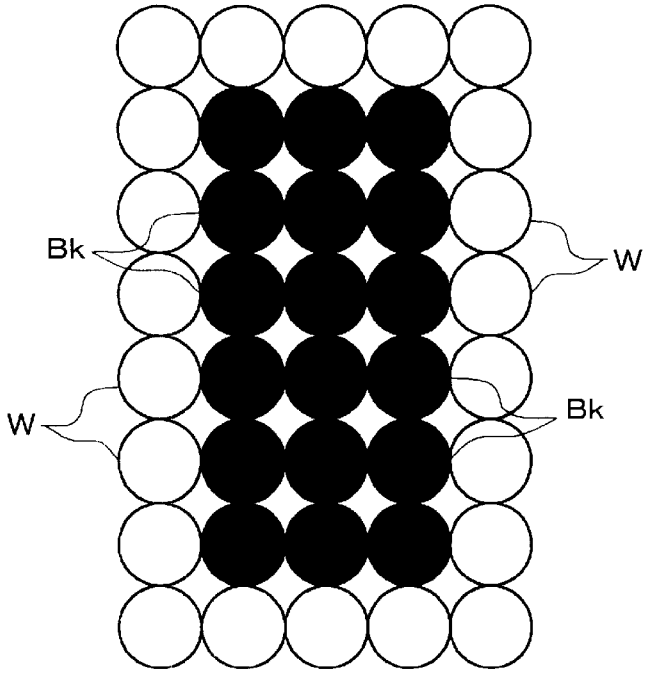
FIG. 17 is a diagram showing a state of ink jet when applying white ink outside a black area so that the white ink adjoins an outline of the black area.

Additionally, in the Third and Fourth Embodiments above, as in the Second Embodiment, it is possible that the size of a dot to be formed with white ink W is set to be slightly larger than the size of a dot to be formed with black ink Bk. Further, the Third and Fourth Embodiment may also have an arrangement in which, as shown in FIG. 17, white ink W or clear ink is applied in a position externally adjacent to an outline of a black area. In addition, it is also within the scope of technical thought of the present invention to previously apply quickly drying white ink W or clear ink to an area inside the black area.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink and said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink onto the recording medium, in a position adjacent to a position on the recording medium where said slowly drying ink is to be applied, and area recognition means for recognizing an area on said recording medium where an image to be formed through the application of said slowly drying ink, wherein said ink discharge control means, in receipt of output of said area recognition means, controls discharge of said quickly drying ink so as to apply said quickly drying ink in a position externally adjacent to an outline of said area.

2. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink and said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink onto the recording medium, either in the same position on the recording medium where said slowly drying ink is to be applied or in an area overlapping an area on the recording medium where an image is to be formed through the application of said slowly drying ink, and text area recognition means for recognizing an area where text is to be printed, out of said area on the recording medium where an image is to be formed through the application of said slowly drying ink, wherein said ink discharge control means, in receipt of output of said text area recognition means, control discharge of said quickly drying ink so as to previously apply said quickly drying ink over said area where text is to be printed.

3. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink into the recording medium, in a position adjacent to a position on the recording medium where said slowly drying ink is to be applied, and text area recognition means for recognizing an area where text is to be printed, out of said area on the recording medium where an image is to be formed through the application of said slowly drying ink, wherein said ink discharge control means, in receipt of output of said text area recognition means, controls discharge of said quickly drying ink so as to previously apply said quickly drying ink in a position adjacent to said area where text is to be printed.

4. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink and said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink onto the recording medium, either in the same position on the recording medium where said slowly drying ink is to be applied or in an area overlapping an area on the recording medium where an image is to be formed through the application of said slowly drying ink, and pictorial image area recognition means for recognizing an area where a pictorial image is to be formed, out of said area on the recording medium where an image is to be formed through the application of said slowly drying ink; and discharge regulation means for regulating, in receipt of output of said pictorial image area recognition means, control operations of discharge of ink by said ink discharge control means so as to inhibit discharge of said white or clear, colorless quickly drying ink to said area where a pictorial image is to be formed.

5. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink and said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink onto the recording medium, in a position adjacent to a position on the recording medium where said slowly drying ink is to be applied, and pictorial image area recognition means for recognizing an area where a pictorial image is to be formed, out of said area on the recording medium where an image is to be formed through the application of said slowly drying ink; and discharge regulation means for regulating, in receipt of output of said pictorial image area recognition means, control operations of discharge of ink by said ink discharge control means so as to inhibit discharge of said white or clear, colorless quickly drying ink in a position adjacent to said area where a pictorial image is to be formed.

6. An ink jet image forming device which performs image information on a recording medium by using quickly drying ink and slowly drying ink in combination, said quickly drying ink being white or clear, colorless ink, comprising:

ink discharge control means for controlling discharge of said quickly drying ink and said slowly drying ink so that said quickly drying ink and said slowly drying ink are applied onto said recording medium either one over another or adjacently, said ink discharge control means controls discharge of said quickly drying ink so as to previously apply said white or clear, colorless quickly drying ink, prior to application of said slowly drying ink onto the recording medium, either in the same position on the recording medium where said slowly drying ink is to be applied or in an area overlapping an area on the recording medium where an image is to be formed through the application of said slowly drying ink, and text area recognition means for recognizing an area where text is to be printed, out of said area on the recording medium where an image is to be formed through the application of said slowly drying ink, wherein said ink discharge control means, in receipt of output of said text area recognition means, controls discharge of said white or clear, colorless quickly drying ink so as to previously apply said quickly drying ink in a way which covers or overlaps said area where text is to be printed.

7. An ink jet image forming device which performs image formation on a recording medium by using quickly drying ink and slowly drying ink in combination, said quickly drying ink being white or clear, colorless ink, comprising:

text area recognition means for recognizing an area where text is to be printed, out of an area on the recording medium where an image is to be formed through the application of said slowly drying ink; and ink discharge control means for controlling discharge of said white or clear, colorless quickly drying ink, in receipt of output of said text area recognition means, so as to previously apply said quickly drying ink in a way which covers or overlaps said area where text is to be printed, or in a position adjacent to said area where text is to be printed.

8. A ink jet image forming device which performs image formation on a recording medium by using quickly drying ink and slowly drying ink in combination, said quickly drying ink being white or clear, colorless ink, comprising:

pictorial image area recognition means for recognizing an area where a pictorial image is to be formed, out of an area on the recording medium where an image is to be formed through the application of said slowly drying ink; and ink discharge control means for controlling discharge of said white or clear, colorless quickly drying ink, in receipt of output of said pictorial image area recognition means, so as to inhibit discharge of said quickly drying ink to said area where the pictorial image is to be formed or in a position adjacent to said area where the pictorial image is to be formed.

* * * * *